United States Patent [19]

Paglia

[11] 4,439,641

[45] Mar. 27, 1984

[54] ULTRASONIC TRANSDUCER FOR USE IN A VIBRATORY ENVIRONMENT

[75] Inventor: Richard Paglia, Carlisle, Mass.

[73] Assignee: Polaroid Corporation, Cambridge, Mass.

[21] Appl. No.: 298,577

[22] Filed: Sep. 2, 1981

[51] Int. Cl.[3] ..... H04R 19/00

[52] U.S. Cl. ..... 179/111 R; 179/111 E; 179/180

[58] Field of Search ..... 179/111 R, 111 E, 180

[56] References Cited

U.S. PATENT DOCUMENTS 4,085,297 4/1978 Paglia ..... 179/111 R
4,199,246 4/1980 Muggli ..... 354/195
4,409,441 10/1983 Murray, Jr. et al. ..... 179/111 R

*Primary Examiner*—A. D. Pellinen
*Assistant Examiner*—Danita R. Byrd
*Attorney, Agent, or Firm*—John J. Kelleher

[57] ABSTRACT

A capacitance-type electrostatic transducer is provided that can be operated in an environment where it may be subjected to excessive mechanical vibrations. Unwanted gain variations and/or spurious electrical signals produced by said transducer when operated in such an environment are precluded, at reduced cost, by mechanically attaching the electrically conductive transducer spring that urges the backplate into cooperative engagement with the vibratile diaphragm of said transducer, to said transducer backplate.

13 Claims, 15 Drawing Figures

ULTRASONIC TRANSDUCER FOR USE IN A VIBRATORY ENVIRONMENT

BACKGROUND OF THE INVENTION

1. Field of the Invention

The present invention relates to an electroacoustical transducer assembly, in general, and to the apparatus for urging a backplate into cooperative engagement with a vibratile diaphragm in such a transducer, in particular.

2. Description of the Prior Art

Capacitance-type electroacoustical transducers are well known in the prior art. In such transducers, a diaphragm having an insulative layer and an electrically conductive surface has its insulative layer in contact with a grooved, irregular, electrically conductive surface of a substantially inflexible disc or backplate. The periphery of the diaphragm is maintained in a fixed position with respect to the transducer housing and a spring force urges said backplate into tensioning engagement with said diahphragm. The insulative layer, the electrically conductive surface of said diaphragm constituting a first electrode, and the conductive surface of said backplate constituting a second electrode, form a capacitor such that when a dc bias voltage is applied across said electrodes, irregularities in said backplate surface set up localized concentrated electric fields in said insulative layer. When an ac signal is superimposed on said dc bias, the diaphragm is stressed such that oscillatory formations develop causing an acoustical wavefront to be propagated from said diaphragm. A received acoustical wavefront impinging on the diaphragm produces a variable voltage across said capacitor electrodes.

In apparatus employing a transducer of the type mentioned above to measure object distance, such as the autocamera sold by Polaroid Corporation under its registered trademark SX-70 Sonar One Step!, the distance to the subject to be photographed is determined by the well-known technique of measuring the round-trip time-of-flight of a burst of ultrasonic energy between an ultrasonic energy generating transducer and said subject to be photographed. This type of transducer has both transmitting and receiving modes of operation. In the transmit mode, an electronic device causes the transducer to transmit a burst of ultrasonic energy toward a subject. In the receive mode, this same transducer detects the previously transmitted ultrasonic energy reflected from said subject that impinges on said transducer's vibratile diaphragm. The elapsed time from initiation of energy transmission until receipt of an echo of said transmitted energy is a fairly accurate measure of subject distance.

In a capacitance-type ultrasonic transducer such as that described in my U.S. Pat. No. 4,085,297, an electrically conductive spring member is employed to urge the backplate of a transducer into cooperative engagement with the vibratile diaphragm of said transducer. In addition to its force-producing function, the spring member also forms a part of the electrical circuit or path that electrically couples the transducer to electronic circuitry external of said transducer. If such a capacitance-type transducer is operated in an environment where it is subjected to excessive mechanical vibrations after it has transmitted an ultrasonic burst of energy toward, for example, an object whose distance is to be determined while said transducer is in its receive mode waiting for the receipt of an echo of said ultrasonic burst of energy from said object, when said excessive vibrations occur, a spurious object detect signal may be generated by the transducer if the intensity of the vibrations are sufficient to temporarily separate the electrically conductive, signal carrying spring member from its associated backplate. In addition, such vibrations may also cause a slight lateral movement of the spring member with respect to its associated backplate and cause a change in the amount of tensioning of the vibratile diaphragm produced by said spring member, thereby causing a change in the effective gain or amplification associated with said capacitance-type transducer by such relative spring member movement.

In U.S. Pat. No. 4,409,441, filed July 2, 1981, by Joseph E. Murray, Jr. et al., the electrically conductive diaphragm tensioning spring of a capacitance-type transducer employed to urge the backplate into proper tensioning engagement with the vibratile diaphragm of said transducer and to couple the transducer to external circuitry is laser welded to the transducer backplate in order to preclude undesirable spurious signal generating relative movement between said backplate and said spring. Attaching the spring to the backplate in this manner enables the transducer to be effectively employed in a vibratory environment. However, welding these components together necessitates employing additional assembly steps in the transducer assembly process which has a substantial negative impact on transducer assembly costs.

SUMMARY OF THE INVENTION

In accordance with the teachings of the present invention, a capacitance-type electroacoustical transducer is provided that is capable of satisfactorily operating in an excessively vibratory environment. The transducer includes a vibratile diaphragm, a backplate and a spring for electrically connecting said backplate to an external electrical circuit and for urging said backplate into proper cooperative engagement with said diaphragm. Means are provided for mechanically attaching a portion of the transducer spring to the backplate in order to preclude spurious signal generation and/or an undesirable change in transducer gain that might otherwise occur if spring movement relative to said backplate was not so precluded without adding additional parts or changing transducer performance, said mechanical coupling means significantly reducing transducer assembly costs over those associated with prior transducer assembly techniques.

DESCRIPTION OF THE PREFERRED EMBODIMENTS

Figure 1A:
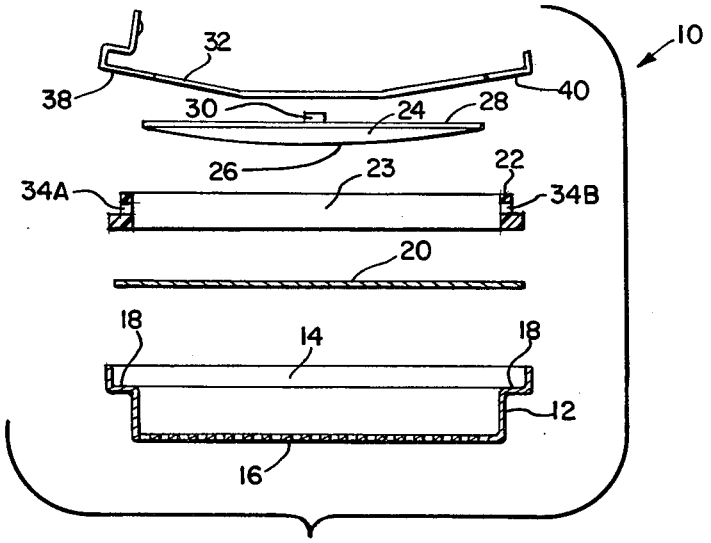
FIG. 1A is an exploded elevational view, partly in section, of the electroacoustical transducer of the present invention.
Figure 2:
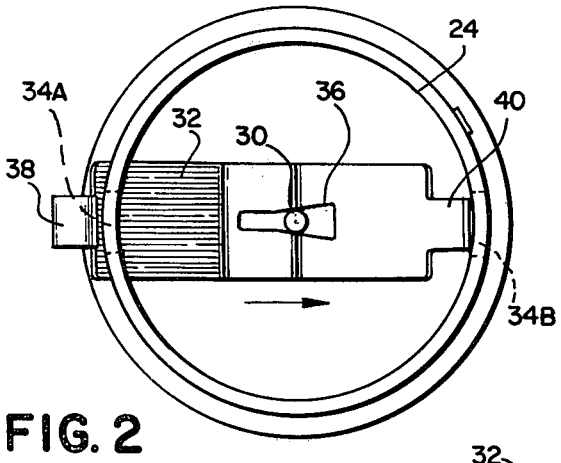
FIG. 2 is a top view of the transducer of FIG. 1A, partly assembled.

Referring now to the drawings and specifically to FIG. 1A, an electroacoustical transducer 10 constructed in accordance with the teachings of the present invention is depicted. Transducer 10 includes cylindrical electrically conductive housing 12 having open end 14 at one end and partially closed perforated end 16 at the other. Electrically conductive housing 12 also includes flanged portion 18 near open end 14 of said housing 12. Flat vibratile diaphragm 20, having electrically conductive and electrically non-conductive surfaces on opposite sides thereof, extends across opening 14 and is positioned between circular diaphragm support ring 22 and said housing 12 with its said electrically conductive surface adjacent said opening 14. Diaphragm 20 is made from a polyimide film sold by the E. I. Dupont DeNemours and Co., Inc. under its registered trademark KAPTON. One surface of diaphragm 20 is electrically conductive in that it is coated with a thin layer of gold and the other surface is electrically non-conductive KAPTON. Diaphragm support ring 22 is of circular cross section with an opening 23 through the center thereof and has a flanged end for cooperative engagement with flanged portion 18 of housing 12. Aluminum backplate 24, of circular cross section, having electrically conductive external surfaces, includes grooved and crowned electrically conductive surface 26 on one side thereof for cooperative engagement with the non-conductive (KAPTON) surface of diaphragm 20, and surface 28 on the side opposite said conductive surface having tactile discontinuity or raised portion 30 projecting therefrom. Stainless steel leaf spring 32 provides the force that maintains backplate 24 in proper cooperative engagement with diaphragm 20. When partly assembled, the transducer components described in FIG. 1A are in the positions shown in FIG. 2 and when fully assembled, said transducer components described with respect to FIG. 1A are in the positions shown in FIGS. 3 and 4.

Figure 3:
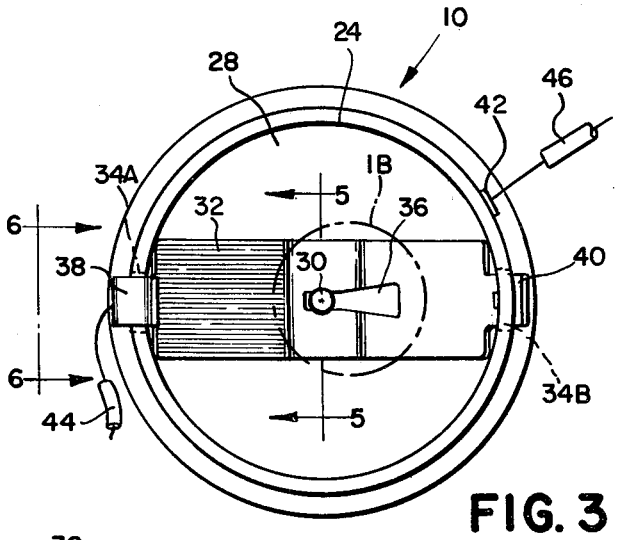
FIG. 3 is a top view of the transducer of FIG. 1A, fully assembled.
Figure 5:
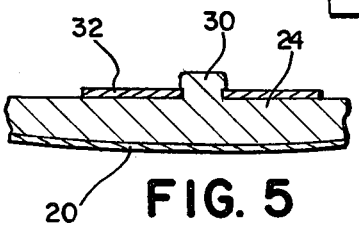
FIG. 5 is a sectional view taken on the line 5—5 in FIG. 3.

The transducer of FIGS. 1A–4 is assembled by placing a light, uniform, radial force on diaphragm 20 for the purpose of temporarily maintaining said diaphragm in a relatively flat plane and then positioning said diaphragm over opening 14 (FIG. 1A) of housing 12. Diaphragm 20 is then "dished" or formed into the crowned shape of a subsequently mating backplate member. The periphery of said diaphragm 20 is then sandwiched between the flanged end of ring 22 and flange portion 18 of housing 12, and then the open end of housing 12 is clamped onto said ring 22 which places the periphery of diaphragm 20 in a fixed position with respect to said housing 12 and the electrically conductive surface of diaphragm 20 in direct electrical contact with said electrically conductive housing 12. Crowned backplate 24 is placed in opening 23 of support ring 22 such that crowned surface 26 of said backplate 24 engages the non-conductive surface of diaphragm 20 which has already been "dished" or placed into the same shape as said crowned surface 26 of backplate 24. With backplate 24 so positioned, relatively hard and flat stainless steel leaf spring 32 is inserted through openings 34A, 34B in support ring 22 such that a portion of the sides of tactile discontinuity or opening 36 in said spring 32 cuts into the base of or engages relatively soft, raised portion or boss 30 of aluminum backplate 24 in an interference relationship as it is first moved through T-shaped opening 34A in ring 22 (FIGS. 1A and 6) from the position shown in FIG. 2 where said spring opening initially engages said raised backplate portion 30 and is then moved through rectangular opening 34B in said ring 22 where the sides of opening 36 in spring member 32 engages the base of said raised backplate portion 30 in said interference relationship as shown in FIG. 3. FIGS. 1B, 1C, 3 and 5 show this spring-to-backplate interference relationship. FIG. 1B is an enlargement of detail 1B in FIG. 3, FIG. 1C is a sectional view taken on the line 1C—1C in FIG. 1B, and FIG. 5 is a partial sectional view taken on line 5—5 in said FIG. 3. Moving spring 32 of transducer 10 into interference engagement with boss 30 would ordinarily require an excessive amount of spring movement force on spring 32 in order to cut into said boss 30 if means were not provided to reduce the amount of force required to produce said interference engagement. One such force reducing arrangement is shown in FIGS. 1B, 1C, 3 and 5.

Referring now to FIGS. 1B, 1C, 3 and 5, the periphery of opening 36 in leaf spring 32 includes tapered side 36A at one end and opposed parallel cutting edges 36B at the other. In addition, raised portion or boss 30 of backplate 24 includes striated outer surface 30A. The stria are parallel to one another and are equally spaced around the periphery, generally at right angles to surface 28 (FIG. 1A) of backplate 24. As spring 32 is moved through opening 34A in ring 22 (FIGS. 1A, 6) boss 30 of backplate 24 initially engages tapered sides 36A of opening 36, and then striated surface 30A of boss 30 engages opposed parallel cutting edges 36B. By striating surface 30A of boss 30, there is less material on boss 30 for cutting edges 36B to cut through and therefore less force required to place opening 36 of leaf spring 32 in interference engagement with boss 30 by this spring 32-to-boss 30 cutting movement.

Figure 6:
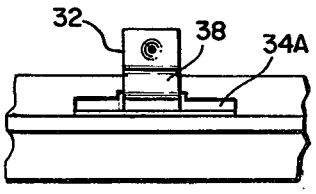
FIG. 6 is an elevational view taken on the line 6—6 in FIG. 3.
Figure 4:
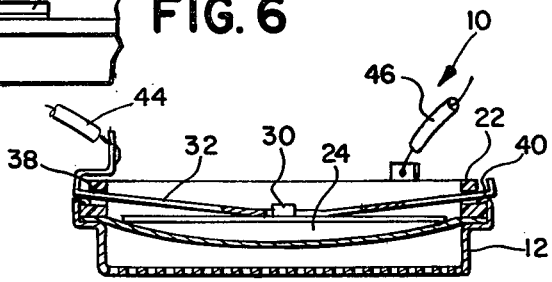
FIG. 4 is an elevational view, partly in section, of the transducer of FIG. 1A fully assembled.

Opening 34A in ring 22 is a T-shaped opening and when spring 32 is in the position shown in FIGS. 3 and 4, narrowed end 38 of spring 32 moves or springs into the vertical portion of T-shaped opening 34A as shown in FIG. 6, said FIG. 6 being a partial elevational view taken on the line 6—6 in FIG. 5. In addition, when spring 32 is in the position shown in FIG. 3, bent and narrowed end 40 of said spring 32 located opposite said narrowed spring end 38 becomes interlocked with the outer surface of ring 22. In this position, spring 32 is placed in a fixed relationship with respect to backplate 24 as explained above, and movement of said spring 32 parallel to surface 28 of backplate 24 is limited by the engagement of the non-narrowed portion of spring 32 with the inner cylindrical surface of support ring 22. When in the position shown in FIGS. 3 and 4, the center portion of leaf spring 32 presses against backplate 24 and the ends of leaf spring 32 rest against the side walls in openings 34A, 34B of said support ring 22. With leaf spring 32 so positioned, diaphragm 20 will be in proper cooperative engagement with crowned surface 26 of backplate 24 and said leaf spring 32 will be in electrical contact with the crowned and grooved surface 26 of backplate 24 through the electrically conductive aluminum of said backplate 24.

Figure 12:
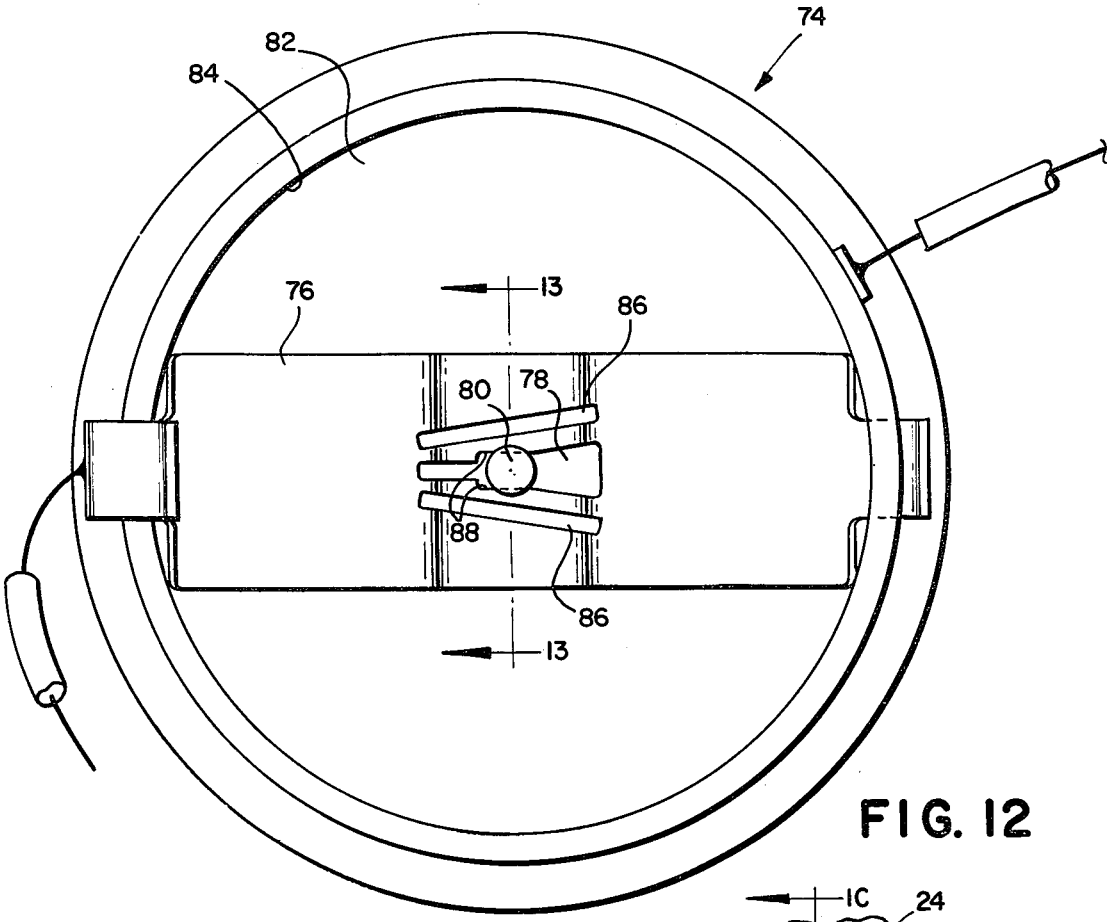
FIG. 12 is a top view similar to that in FIG. 3 of a transducer employing an alternate form of the leaf spring shown in said FIG. 3.
Figure 13:
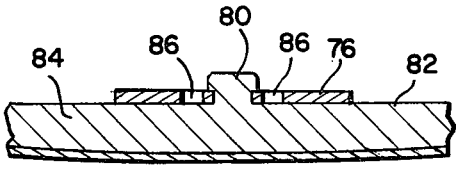
FIG. 13 is a cross-sectional view taken on the line 13—13 in FIG. 12.
Figure 1B:
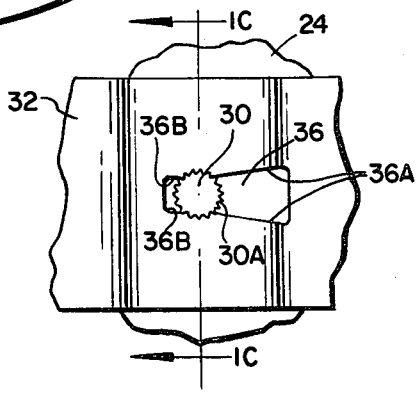
FIG. 1B is an enlargement of detail 1B in FIG. 3.
Figure 1C:
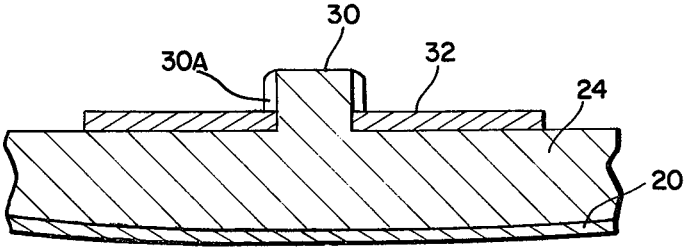
FIG. 1C is a sectional view taken on the line 1C—1C in FIG. 1B.

Alternate means for mechanically coupling the leaf spring to the backplate of an electroacoustical transducer in an interference relationship with reduced force is shown in drawing FIGS. 12 and 13. FIG. 12 is an enlarged top view of transducer 74, a view that is similar to the top view of transducer 10 shown in FIG. 3. FIG. 13 is a cross-sectional view taken on the line 13—13 in FIG. 12. In transducer 74, leaf spring 76 and opening 78 in said leaf spring 76 are approximately the same as leaf spring 32 and opening 36 in transducer 10 with the exception being the slightly longer length of opening 78. However, raised portion or boss 80 projecting from surface 82 of backplate 84 in transducer 76 is a right circular cylinder with a smooth outer cylindrical surface and is not striated as is the outer surface of boss 30 in transducer 10. In addition, leaf spring 76 of transducer 74 also includes elongated slots or openings 86 on opposite sides of main or central opening 78. In all other respects, transducer 74 in FIG. 12 is the same as transducer 10 in, for example, FIG. 3.

As spring 76 is moved across surface 82 of backplate 84 in the same manner that spring 32 was moved across surface 28 in transducer 10 (FIG. 3), parallel edges or sides 88 of opening 78 in spring 76 engage and then cut into the cylindrical sides of boss 80 in an interference relationship. The presence of slots 86 enables opening 78 to enlarge, to a limited degree, as edges 88 of opening 78 cut into boss 80. By enlarging in this manner, sides 88 in opening 78 make a shallower cut into boss 80 than the cut made by edges 36B (FIG. 1B) into boss 30 of transducer 10. By making a shallower cut, less force is required to place spring 76 into interference engagement with boss 80. In addition, the outward flexed edges 88 of opening 78 place a gripping force on boss 80 that reduces the liklihood of relative movement between spring 76 and boss 80 that might otherwise result if transducer 74 is excessively vibrated.

A capacitor-type electroacoustical transducer of the type described above has been employed in object distance determining ranging systems. One such system is described in U.S. Pat. No. 4,199,246 to MUGGLI. In operation, a high frequency electrical signal is impressed on narrowed end 38 of spring 32 and terminal 42 of transducer 10 through conductors 44, 46, respectively, (FIGS. 3 and 4) which cause the diaphragm of transducer 10 to vibrate and thereby propagate an acoustical wavefront toward and object whose distance is to be measured. An echo of said acoustical wavefront impinging on transducer 10 will cause diaphragm 20 of transducer 10 to vibrate and thereby produce an object detect signal between said conductors 44, 46. The time of flight of said acoustical wavefront or signal from transmission to receipt of an echo of said acoustical signal provides a fairly good measure of object distance. Both the acoustical wavefront generating transmit signal and the vibrating diaphragm produced echo signal appear at the same transducer 10 conductors (conductors 44, 46), but at different points in time.

Figure 7:
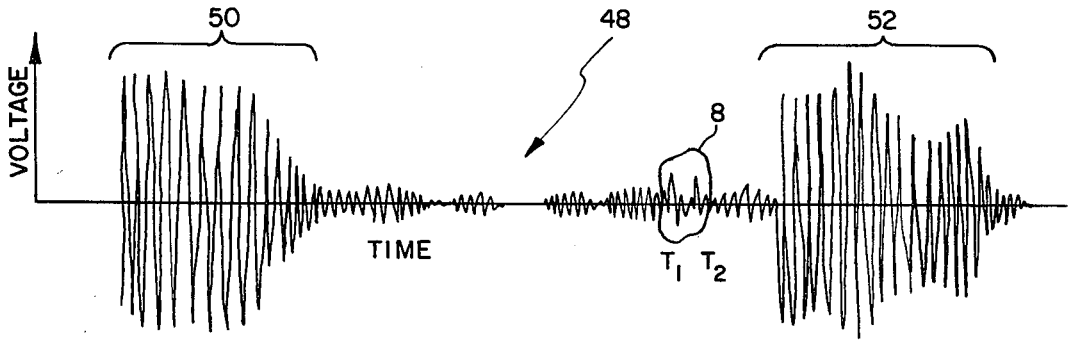
FIG. 7 is a typical trace of a transmit and receive signal appearing at the input/output terminals of the transducer of FIGS. 3 and 4, showing signal voltage as a function of time.

A typical transducer 10 transmit and receive signal 48 is shown in drawing FIG. 7. In FIG. 7, voltage variations of transmit and receive signal 48 are shown as a function of time. Signal 48 has three fairly distinct time-dependent divisions or segments. Segment 50 constitutes the transmit portion and segment 52 constitutes the receive portion, respectively, of transmit and receive signal 48. That portion of transmit and receive signal 48 between transmit portion 50 and receive portion 52 constitutes background, electronic and/or other noise present on transducer 10 conductors 44, 46 after the completion of transmit portion 50 of transmit and receive signal 48 but before the receipt of receive portion 52 of said signal 48. It is during this noise portion of transmit and receive signal 48 that the electronics associated with transducer 10 is listening for a reflection, echo or receipt of a previously transmitted transmit signal. If a spurious signal of sufficient magnitude and duration should appear between conductors 44, 46 of transducer 10 during this listening interval of time, an erroneous object distance signal may be generated by a ranging system incorporating such a transducer.

As explained above, leaf spring 32 of transducer 10 forms a portion of the electrical circuit between external circuitry and grooved and crowned electrically conductive surface 26 of backplate 24. The electrical connection between leaf spring 32 and backplate 24 is maintained, in part, by the spring force of spring 32 causing said spring 32 to press on electrically conductive surface 28 of backplate 24, a surface that is electrically connected to said grooved and crowned electrically conductive surface 26 of backplate 24.

If the mechanical coupling arrangement described above for fixedly attaching spring 32 to raised portion 30 of backplate 24 in an interference relationship were not employed and transducer 10 was subjected to mechanical vibrations of sufficient magnitude and duration, the forces produced by such vibrations may exceed the electrical contact maintaining force produced by leaf spring 32 and thereby cause the separation of said leaf spring 32 from backplate 24 and a momentary break in the electrical circuit between electrical conductor 44 (FIG. 3) attached to leaf spring 32 and electrically conductive grooved and crowned surface 26 of said backplate 24. If this momentary electrical circuit break should occur between times $T_1$ and $T_2$ (FIGS. 7 and 8) after completion of the transmit signal 50 portion of transmit and receive signal 48, but before the receipt of receive signal portion 52 of said signal 48 as shown, for example, in drawing FIG. 7, an erroneous object distance signal would be produced by the electronics (not shown) associated with transducer 10. As mentioned above, when transducer 10 is subjected to excessive mechanical vibrations, leaf spring 32 may temporarily move away from electrically conductive surface 28 of backplate 24. The effect of such movement is shown in FIG. 8 which is an enlargement of detail 8 in FIG. 7.

Figure 8:
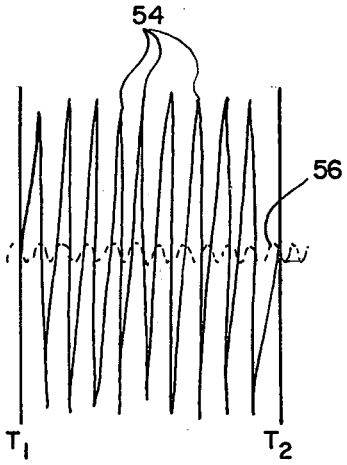
FIG. 8 is an enlargement of detail 8 in FIG. 7.

In FIGS. 7 and 8, $T_1$ is a point in time when, without the coupling apparatus of the present invention, the electrical connection between leaf spring 32 and backplate 24 would be broken, and $T_2$ is the point in time when said broken electrical connection between spring 32 and backplate 24 would be reestablished. With particular reference to FIG. 8, if spring 32 should separate from surface 28 of backplate 24 without the benefit of the above-mentioned spring 32-to-backplate 24 coupling, voltage oscillations 54 may be generated by such separation having a magnitude approximating that of a true echo or receive signal which could falsely indicate to the above-mentioned electronics associated with transducer 10 that a particular object had been detected, a false signal magnitude that may be several orders of magnitude greater than background noise 56, for example, noise that would otherwise occur between times $T_1$ and $T_2$ if a separation of leaf spring 32 from backplate 24 should not occur.

Figure 9:
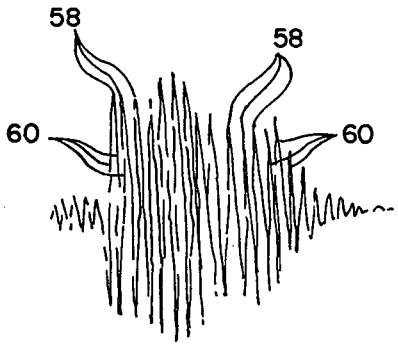
FIG. 9 is a trace of the receive signal portion of the transmit and receive signal of FIG. 7 showing two receive signal gain levels.

In addition to the possibility of temporarily breaking the electrical connection between leaf spring 32 and backplate 24 without the mechanical coupling arrangement of the present invention, excessive mechanical vibrations may also cause lateral movement of said spring 32 with respect to surface 28 of backplate 24. Such lateral movement would change the point on backplate 24 where the spring 32 produced tensioning force is applied to said backplate 24 by said spring 32, which may change the tension on diaphragm 20 produced by diaphragm tensioning leaf spring 32, a change in tension which may affect transducer 10 gain or the amplitude of the electrical signal produced between electrical conductors 44, 46 (FIG. 3) resulting from an echo of an acoustical wavefront impinging on diaphragm 20 of transducer 10. As shown in FIG. 9, a receiver signal that might otherwise have the amplitude of receive signal 58 before such lateral spring member movement occurred, may have the lower amplitude of receive signal 60 after lateral spring member movement, or vice versa. The object distance determining electronics associated with transducer 10 (not shown) is normally sensitive to receive signal amplitude and a change in receive signal amplitude resulting from such lateral spring member movement may also produce an erroneous object distance signal.

Figure 10:
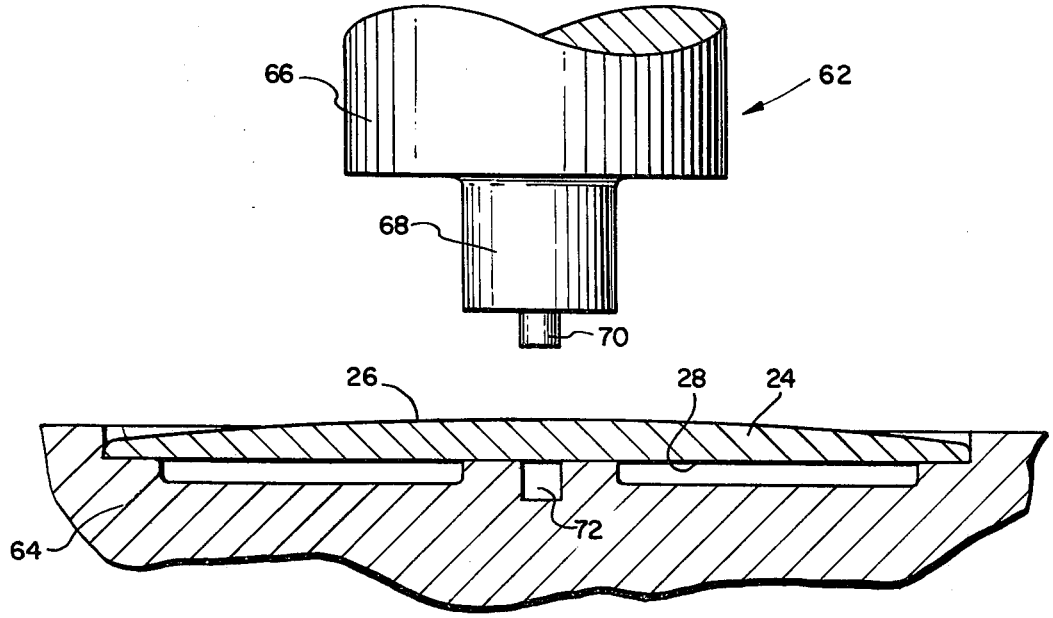
FIG. 10 is an elevational view of a transducer backplate assembly tool and a backplate positioned on said tool for subsequent shaping by said assembly tool.
Figure 11:
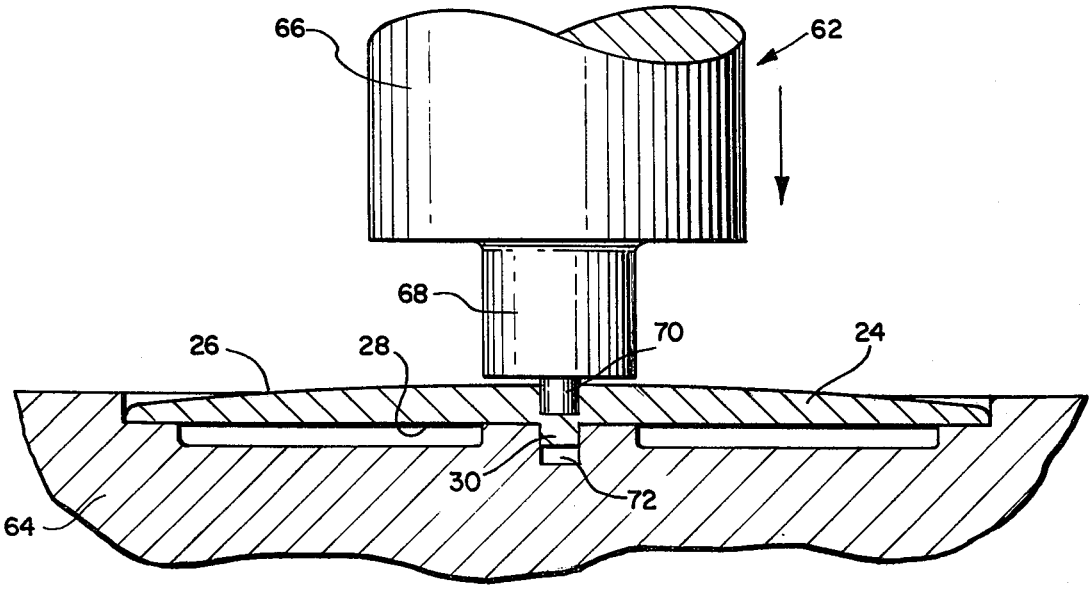
FIG. 11 is an elevational view of the backplate and assembly tool of FIG. 10 showing said backplate after it has been shaped by said assembly tool.

The tactile discontinuity or raised portion 30 projecting from surface 28 of aluminum backplate 24 for interference engagement with relatively hard stainless steel leaf spring 32 is produced by die-forming tool 62 shown in FIGS. 10 and 11. FIG. 10 shows backplate 24 nested in backplate support member 64 just prior to the forming of raised portion 30 in said backplate 24, and FIG. 11 shows backplate 24 after said raised portion 30 has been formed, but before a portion of the die-forming tool 62 that produced said raised portion 30 has been withdrawn from said backplate 24.

With reference to FIG. 10, backplate 24 is positioned in backplate support member 64 with its relatively flat surface 28 resting on said member 64 and with the grooved and crowned surface 26 of backplate 24 that is opposite said flat surface 28 projecting upward from support member 64. Vertically movable cylindrical rod 66 having narrowed portion 68 at one end thereof has removably mounted cylindrical punch 70 attached to said narrowed rod portion 68. Force transmitting cylindrical rod 66 coupled to force producing means (not shown) that selectively couples the proper magnitude force to said removable punch 70 and to backplate 24.

As shown in FIG. 11, rod 66 is moved vertically downward to the point where punch 70 engages the geometrical center of curved and grooved surface 26 of backplate 24 and causes the center portion of surface 28 to be extruded a predetermined depth into the cylindrical extrusion die 72 portion of backplate support member 64. The cylindrical surface of extrusion die portion 72 may be smooth as in FIGS. 12, 13, or striated as in FIGS. 1B, 1C. That portion of backplate 24 partially extruded into said die portion 72 by punch 70 forms the previously described tactile discontinuity or raised portion 30 that subsequently engages tactile discontinuity or opening 36 of stainless steel leaf spring 32 in an interference relationship.

In addition to preventing movement of spring 32 with respect to backplate 24 at the point of contact between these two members, the same electrical resistance is maintained between said spring 32 and said backplate 24 by the abovedescribed interference engagement between spring 32 and backplate 24. The surface of metals such as aluminum or stainless steel from which backplate 24 and leaf spring 32 are respectively made will oxidize, to varying degrees, over extended periods of time. If transducer 10 were subjected to excessive mechanical vibration as defined above, even while in an inactive state, without the benefit of the mechanical coupling of the present invention, movement of spring member 32 with respect to backplate 24 may cause a portion of an oxidized surface of one or both of these members to be included in the point of contact between the spring and backplate and thereby change the electrical resistance between these two members. The greater the electrical resistance between the spring and backplate, the greater, for example, will be the amount of signal voltage produced by the vibration of diaphragm 20 that is lost or dropped across this increased resistance, and the smaller will be the amount of said signal voltage between conductors 44, 46 connected to the input/output of transducer 10 that would be available for use in any distance determining electronics associated with said transducer 10 which may also cause said electronics to produced an erroneous object distance signal.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. An electroacoustical transducer assembly, comprising:

a relatively inflexible backplate having an electrically conductive major surface and having another electrically conductive surface, that is electrically connected to said major surface, on the opposite side thereof;

a relatively flexible diaphragm having electrically conductive and electrically nonconductive surfaces on opposite sides thereof; and an electrically conductive spring for connecting said backplate to an electrical circuit, for urging said major backplate surface into engagement with said electrically nonconductive diaphragm surface and for properly tensioning said diaphragm, said spring and said backplate having portions thereof adapted for press fit engagement with one another when said spring is mounted on said transducer assembly to urge said backplate into engagement with said diaphragm surface and to properly tension said diaphragm.

2. The apparatus of claim 1, wherein said backplate includes a raised portion projecting from said opposite-side backplate surface and said spring has an elongated opening therein with the said raised backplate portion projecting therethrough in interfering engagement with said spring to thereby fixedly attach said spring to and place said spring in electrical contact with, said electrically conductive opposite-side backplate surface.

3. The apparatus of claim 2, wherein one end of said opening is partially wedge-shaped and another portion of said opening includes opposed parallel cutting edges and wherein said raised portion is a cylindrical boss, of circular cross section, having a striated surface with the grooves of said striated surface being at generally right angles to said opposite-side backplate surface.

4. The apparatus of claim 2, wherein said spring further includes at least two additional openings with one of said additional openings being on one side and another additional opening being on the opposite side of said elongated opening and immediately adjacent thereto.

5. The apparatus of claim 1, wherein said spring is a leaf-spring.

6. The apparatus of claim 1, wherein said conductive spring is configured to provide an electrically conductive path to an electrical circuit external of said transducer.

7. The apparatus of claim 1, wherein said backplate is constructed of aluminum and said spring is constructed of stainless steel.

8. The apparatus of claim 1, wherein said major backplate surface includes a plurality of concentric grooves.

9. In an electroacoustical transducer assembly comprising a relatively inflexible backplate having electrically conductive opposed major surfaces in common electrical connection, a flexible diaphragm extending across one of said major surfaces, an electrically conductive spring having one portion in engagement with the other of said major surfaces to urge said backplate into proper tensioning contact with said diaphragm and to provide electrical contact to said backplate, the improvement wherein said spring portion is in press fit engagement with a portion of said backplate to provide a vibration resistant conductive path between said spring and said backplate.

10. In an electroacoustical transducer having a diaphragm, a backplate and a spring, said spring being arranged in engagement with one major surface of said backplate to urge another major surface thereof into engagement with said diaphragm and to provide electrical connection to said backplate, the improvement comprising a projection on said backplate, and means carried by said spring for cooperating with said projection in a press fit, to fixedly attach said spring to said backplate in a low electrical resistance connection thereto.

11. The improvement of claim 10, wherein said spring is a leaf-spring configured for sliding movement across a surface of said backplate during assembly of said transducer and includes a tactile discontinuity configured for interfering engagement with said tactile discontinuity of said backplate during said sliding movement.

12. The improvement of claim 10, wherein said tactile discontinuity of said backplate is a raised portion of said one major surface.

13. The improvement of claim 10, wherein said leaf-spring comprises a strip of relatively thin material of a given width having an opening centrally located therein, said opening including a wedge-shaped portion at one end and another portion having opposed, parallel, spaced apart cutting edges, with said one major surface carrying a raised portion of a diameter greater than the separation between said opposed cutting edges but less than at least a portion of the said wedge-shaped opening end, whereby said raised portion may be initially received in said wedge-shaped opening end and then be cutting engaged by said opposed opening cutting edges as said spring is slid across said one major backplate surface.

* * * * *